United States Patent [19]

Shellenberger et al.

[11] Patent Number: 4,974,579

[45] Date of Patent: Dec. 4, 1990

[54] INDUCED DRAFT, FUEL-FIRED FURNACE APPARATUS HAVING AN IMPROVED, HIGH EFFICIENCY HEAT EXCHANGER

[75] Inventors: Timothy J. Shellenberger; William T. Harrigill, both of Fort Smith, Ark.

[73] Assignee: Rheem Manufacturing Company, New York, N.Y.

[21] Appl. No.: 415,121

[22] Filed: Sep. 28, 1989

[51] Int. Cl.[5] ..... F24H 3/00

[52] U.S. Cl. ..... 126/110 R; 126/99 A; 126/111 R

[58] Field of Search ..... 126/110 R, 99 A, 116 R

[56] References Cited

U.S. PATENT DOCUMENTS

| | | | |
|---|---|---|---|
| 601,590 | 3/1898 | Rossman . | |
| 2,353,606 | 7/1944 | Watts | 126/116 R |
| 2,499,358 | 3/1950 | Cooper et al. | 257/2 |
| 2,521,866 | 9/1950 | Ott | 126/110 |
| 2,525,400 | 10/1950 | Crawford | 126/110 R |
| 2,527,937 | 10/1950 | Klug | 126/110 |
| 2,589,555 | 3/1952 | King et al. | 126/110 |
| 2,769,619 | 11/1956 | Juhasz | 257/6 |
| 3,189,017 | 6/1965 | Haun | 126/116 |
| 3,194,214 | 7/1965 | Frendberg | 122/1 |
| 3,358,672 | 12/1967 | Dirk et al. | 126/110 |
| 3,667,451 | 6/1972 | Boucher | 126/110 |
| 3,930,489 | 1/1976 | Anable | 126/99 |
| 4,308,990 | 1/1982 | Borovina | 236/10 |
| 4,478,206 | 10/1984 | Ahn | 126/99 A |
| 4,533,315 | 8/1985 | Nelson | 431/20 |
| 4,557,249 | 12/1985 | Sweedyk | 126/110 |
| 4,561,421 | 12/1985 | Hwang | 126/110 |
| 4,576,226 | 3/1986 | Lipets | 165/134.1 |
| 4,603,681 | 8/1986 | Clawson | 126/110 |
| 4,730,600 | 3/1988 | Harrigill | 126/108 |
| 4,807,588 | 2/1989 | Beatley | 126/110 |

*Primary Examiner*—Carroll B. Dority

*Attorney, Agent, or Firm*—Hubbard, Thurman, Turner, Tucker & Harris

[57] ABSTRACT

An induced draft, fuel-fired upflow furnace is provided with a compact, high efficiency heat exchanger having horizontally spaced apart inlet and outlet manifold structures which are innerconnected by a horizontally spaced series of vertically serpentined, relatively small diameter flow transfer tubes. Larger diameter inlet flow tubes are positioned beneath the balance of the heat exchanger, extend parallel to the transfer tubes, and have upturned discharge ends connected to the underside of the inlet manifold. The heat exchanger is configured so that its total vertically facing peripheral surface area is considerably larger than its total horizontally facing peripheral surface area, thereby significantly reducing undesirable outward heat loss through the vertically extending furnace housing side walls upon burner shut off and increasing the overall efficiency rating of the furnace. The small diameter, serpentined transfer tubes create a significant flow restriction within the heat exchanger to thereby increase heat transfer to the continuing supply air flow through the furnace after burner shut off. The reduced mass of the heat exchanger, compared to conventional clamshell heat exchangers, also desirably lessens its cold start up "dwell time" to inhibit internal heat exchanger corrosion. A pilot bypass system is provided to inhibit internal heat exchanger corrosion potentially caused by the continuously generated combustion products of a standing pilot flame within the furnace housing by venting such combustion products directly through the draft inducer fan outlet section and into the exhaust flue, thereby bypassing the heat exchanger, during idle periods of the furnace.

9 Claims, 3 Drawing Sheets

INDUCED DRAFT, FUEL-FIRED FURNACE APPARATUS HAVING AN IMPROVED, HIGH EFFICIENCY HEAT EXCHANGER

BACKGROUND OF THE INVENTION

The present invention relates generally to fuel-fired, forced air heating furnaces and, in a preferred embodiment thereof, more particularly provides an induced draft, fuel-fired furnace having a specially designed compact, high efficiency heat exchanger incorporated therein.

The National Appliance Energy Conservation Act of 1987 requires that all forced air furnaces manufactured after Jan. 1, 1992, and having heating capacities between 45,000 Btuh and 400,000 Btuh, must have a minimum heating efficiency of 78% based upon Department of Energy test procedures For two primary reasons, each relating to conventional heat exchanger design, the majority of furnaces currently being manufactured do not meet this 78% minimum efficiency requirement.

First, until recently, most furnace efficiencies were rated based upon "indoor ratings", meaning that the heat losses through the furnace housing walls to the surrounding space were ignored, the implicit assumption being that the furnace was installed in an area within the conditioned space (such as a furnace closet or the like) so that the heat transferred outwardly through the furnace housing ultimately functioned to heat the conditioned space. Under the new efficiency rating scheme, however, furnace efficiencies will be penalized for heat transferred outwardly through the furnace housing to the surrounding space on the assumption that the furnace will be installed in an unheated area, such as an attic, even if the furnace will ultimately be installed within the conditioned space.

Gas-fired residential furnaces are typically provided with "clamshell" type heat exchangers through which the burner combustion products are flowed, and exteriorly across which the furnace supply air is forced on its way to the conditioned space served by the furnace. The conventional clamshell heat exchanger is positioned within the furnace housing and is normally constructed from two relatively large metal stampings edge-welded together to form the heat exchanger body through which the burner combustion products are flowed. In the typical upflow furnace, the clamshell heat exchanger body has a large expanse of vertically disposed side surface area which extends parallel to adjacent vertical side wall portions of the furnace housing. In a similar fashion, in horizontal flow furnaces the clamshell heat exchanger body has a large expanse of horizontally disposed side surface area which extends parallel to the adjacent horizontally extending side wall portion of the furnace housing.

Due to the large surface area of clamshell heat exchangers, and its orientation within the furnace housing, there is a correspondingly large (and undesirable) outward heat transfer from the heat exchanger through the furnace housing which represents a loss of available heat when the furnace is installed in an unheated space. This potential heat transfer from the heat exchanger through the furnace housing side walls to the adjacent space correspondingly diminishes the efficiency rating of the particular furnace, under the new efficiency rating formula, even when the furnace is not installed in an unheated space.

The second heat exchanger-related factor which undesirably reduces the overall heating efficiency rating of a furnace of this general type arises from the fact the the typical clamshell heat exchanger has a relatively low internal pressure drop. Accordingly, during an "off cycle" of the furnace, this "loose" heat exchanger design permits residual heat in the heat exchanger to rather rapidly escape through the exhaust vent system (due to the natural buoyancy of the hot combustion gas within the heat exchanger) instead of being more efficiently transferred to the heating supply air which continues to be forced across the heat exchanger for short periods after burner shutoff. Stated in another manner, in the typical clamshell type heat exchanger the retention time therein for combustion products after burner shut off is quite low, thereby significantly reducing the combustion product heat which could be usefully transferred to the continuing supply air flow being forced externally across the heat exchanger.

In addition to these heating efficiency problems, conventional clamshell type heat exchangers have a long "dwell period" (upon cold start up) during which condensation is formed on their interior surfaces and remains until the hot burner combustion products flowed internally through the heat exchanger evaporates such condensation. This dwell period, of course, is repeated each time the furnace is cycled. Because of these lengthy dwell periods (resulting from the large metal mass of the clamshell heat exchanger which must be re-heated each time the burners are energized), internal corrosion in clamshell heat exchangers tends to be undesirably accelerated.

In view of the foregoing, it is accordingly an object of the present invention to provide an improved heating efficiency furnace having incorporated therein a heat exchanger which eliminates or minimizes the abovementioned and other problems, limitations and disadvantages typically associated with conventional clamshell type heat exchangers.

SUMMARY OF THE INVENTION

The present invention provides an induced draft, fuel-fired furnace having, within its housing, a compact, high efficiency heat exchanger uniquely configured to reduce heat outflow from the heat exchanger through the housing side walls and thereby increase the overall heating efficiency rating of the furnace.

The heat exchanger is disposed within a supply air plenum portion of the housing and has first total peripheral surface area facing parallel to the direction of blower-produced air flow through the supply air plenum and externally across the heat exchanger, and a second total peripheral surface area which outwardly faces a side wall section of the housing in a direction transverse to the air flow across the heat exchanger.

Importantly, the first peripheral surface of the heat exchanger is substantially greater than its second peripheral surface area. Accordingly, the radiant heat emanating from the heat exchanger toward the housing side wall section is substantially less than its radiant heat directed parallel to the air flow. In this manner, the available heat from the heat exchanger is more efficiently apportioned to the supply air, thereby reducing outward heat loss through the furnace housing.

In a preferred embodiment thereof, the heat exchanger includes an inlet manifold, and outlet manifold spaced apart from the inlet manifold in a direction transverse to the supply air flow, a plurality of relatively large diameter, generally L-shaped inlet tubes positioned upstream of the inlet and outlet manifolds and having discharge portions connected to the inlet manifold, and a series of relatively small diameter flow transfer tubes each connected at its opposite ends to the inlet and outlet manifolds, the small diameter flow transfer tubes being serpentined in the direction of supply air flow externally across the heat exchanger.

A plurality of fuel-fired burners are disposed within the furnace housing, and are ignited upon a demand for heat by a standing pilot flame continuously maintained within the housing externally of the heat exchanger. A draft inducer fan has its inlet connected to the heat exchanger outlet manifold, and has an outlet section connectably to an external exhaust flue. During operation of the furnace, the draft inducer fan operates to draw hot combustion products from the burners into the inlets of the heat exchanger primary tubes and then through the balance of the heat exchanger, and discharge the burner combustion products into the external flue.

The serpentined, small diameter flow transfer tubes of the heat exchanger function to create a substantial resistance to burner combustion product flow through the heat exchanger, and impart turbulence to the combustion product throughflow, to thereby improve the thermal efficiency of the heat exchanger.

Despite the relatively high flow pressure drop of the high efficiency heat exchanger, the aforementioned standing pilot flame can be used in conjunction therewith without the risk of the continuously generated pilot flame combustion products migrating through the high pressure drop heat exchanger during idle periods of the furnace and thereby internally corroding the heat exchanger.

The ability to use the simple and relatively inexpensive standing pilot flame ignition system in the furnace of the present invention, instead of the costlier and more complex electric ignition system normally required with a high pressure drop heat exchanger, a small vent conduit or tube is secured at one end to the outlet section of the draft inducer fan, and is extended downwardly therefrom to adjacent the standing pilot flame. The vent tube creates a vent passage through which the combustion products from the standing pilot flame upwardly flow into the draft inducer fan outlet section, and then into the external exhaust flue during idle periods of the furnace (during which neither the draft inducer fan nor the main furnace burners are operating). Accordingly, during such idle periods of the furnace, essentially all of the products of combustion from the standing pilot flame completely bypass the interior of the heat exchanger to thereby prevent such pilot flame combustion products from condensing upon and potentially corroding the interior heat exchanger surface.

During periods of draft inducer fan operation, outflow of burner combustion products from the pressurized interior of the inducer fan outlet section through the vent tube, which might otherwise snuff out the standing pilot flame, is prevented by a vane member secured within the fan outlet section adjacent its juncture with the upper end of the vent tube. In response to the combustion product discharge through the fan outlet section, the vane structure creates a venturi area within the outlet section adjacent the upper end of the vent tube, thereby maintaining a negative pressure within the vent tube.

DETAILED DESCRIPTION

Figure 1:
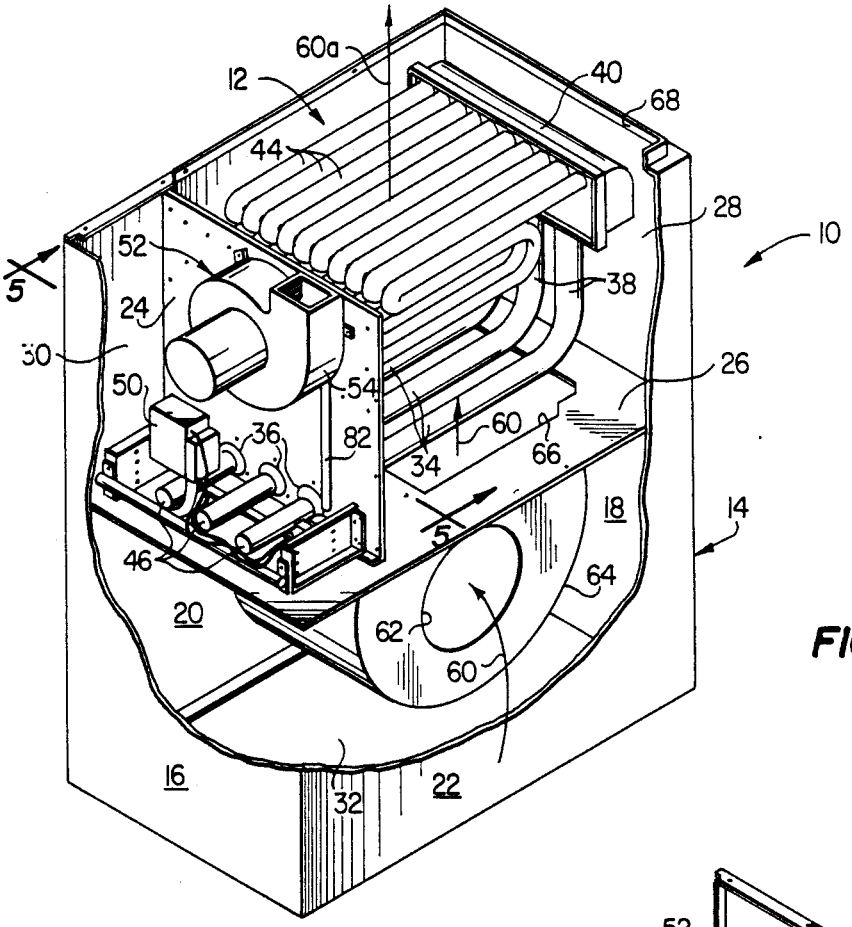
FIGS. 1 and 2 are partially cut away perspective views of an induced draft, fuel-fired furnace embodying principles of the present invention.
Figure 2:
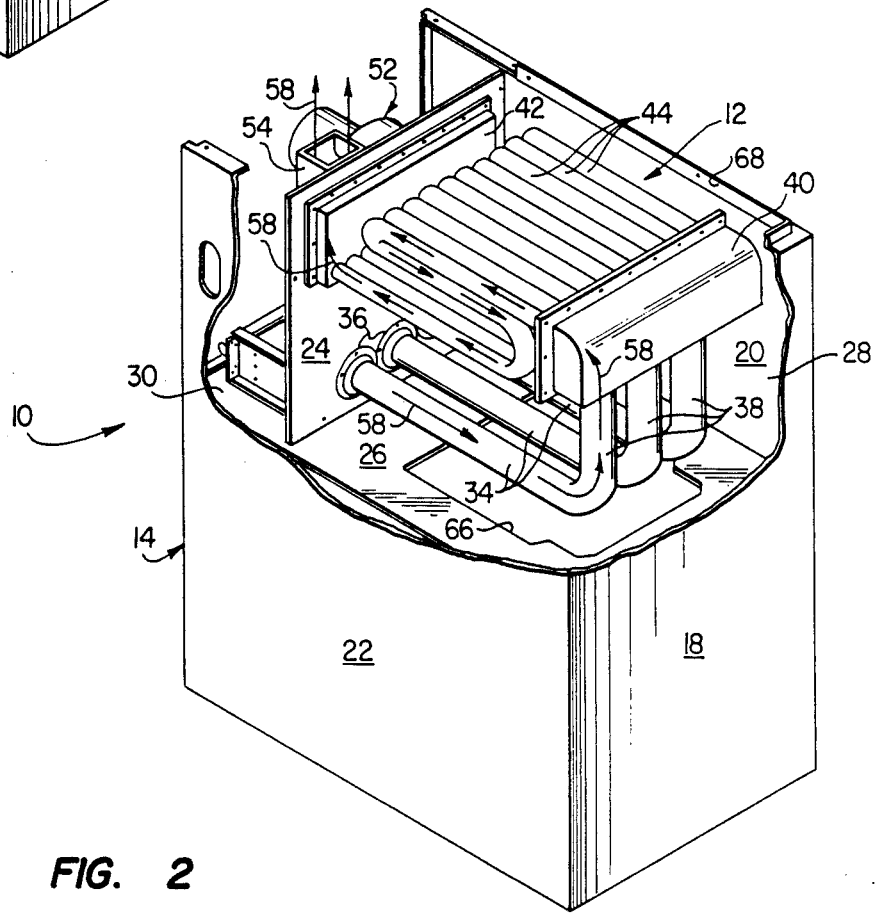

Referring initially to FIGS. 1 and 2, the present invention provides an induced draft, fuel-fired furnace 10 in which a compact, high efficiency heat exchanger 12, embodying principles of the present invention, is incorporated. The furnace 10 is representatively illustrated in an "upflow" configuration, but could alternately be fabricated in a downflow or horizontal flow orientation. The furnace includes a generally rectangularly cross-sectioned housing 14 having vertically extending front and rear walls 16 and 18, and opposite side walls 20 and 22. Vertical and horizontal walls 24 and 26 within the housing 14 divide its interior into a supply plenum 28 (within which the heat exchanger 12 is positioned), a fan and burner chamber 30, and an inlet plenum 32 beneath the plenum 28 and the chamber 30.

Figure 3:
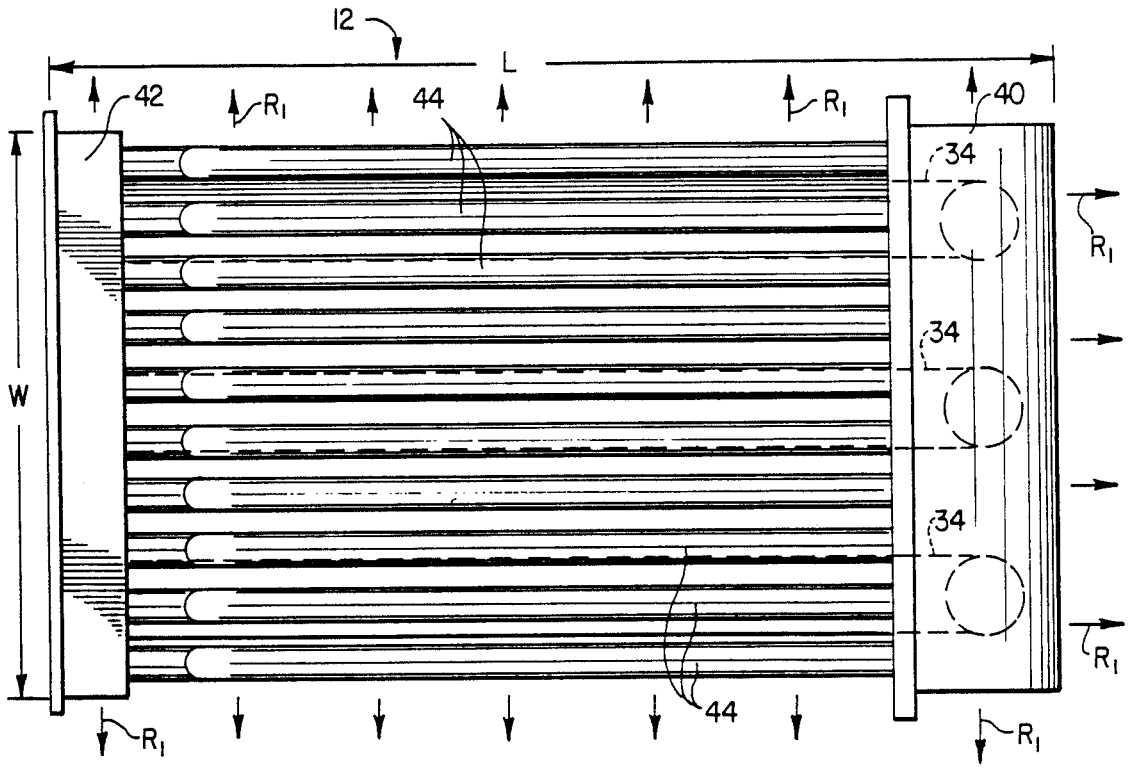
FIG. 3 is an enlarged scale top plan view of a specially designed, high efficiency heat exchanger utilized in the furnace.
Figure 4:
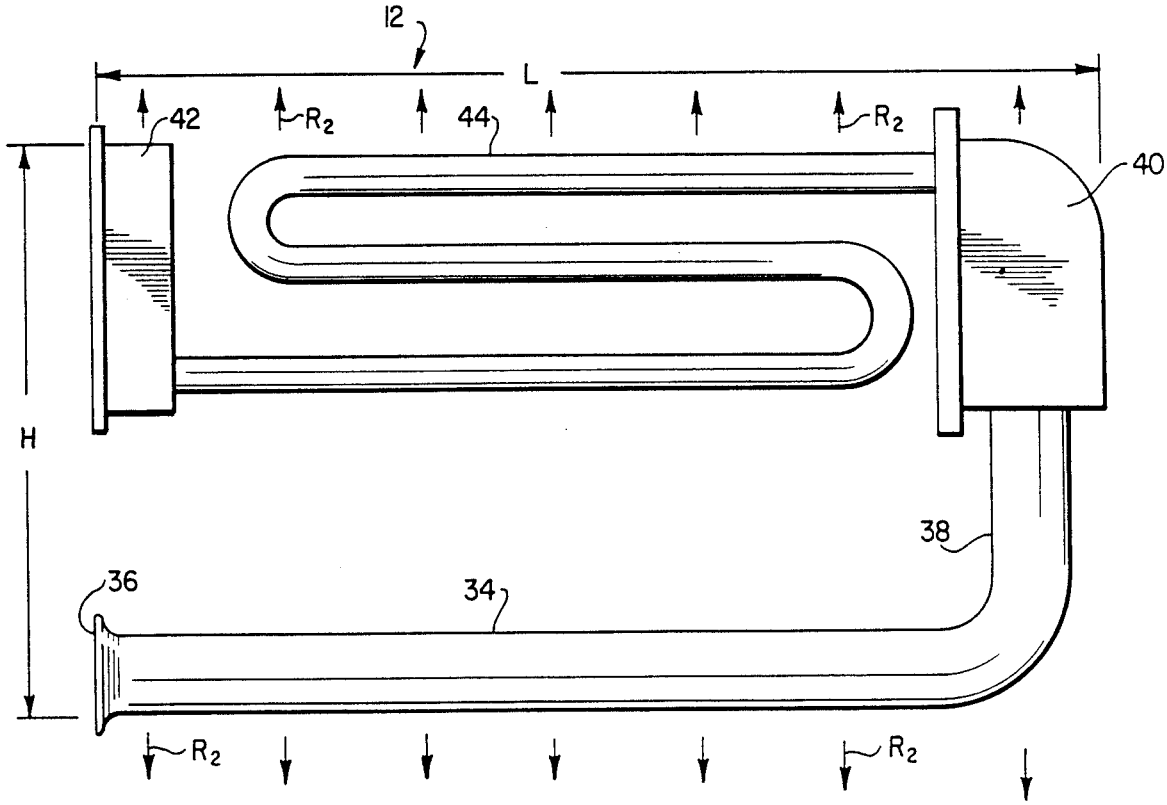
FIG. 4 is an enlarged scale side elevational view of the heat exchanger.

Referring additionally now to FIGS. 3 and 4, the heat exchanger 12 includes three relatively large diameter, generally L-shaped primary tubes 34 which are horizontally spaced apart and secured at their open inlet ends 36 to a lower portion of the interior wall 24. The upturned outlet ends 38 of the primary tubes 34 are connected to the bottom side of an inlet manifold 40 which is spaced rightwardly apart from a discharge manifold 42 suitably secured to an upper portion of the interior wall 24. The interior of the inlet manifold 40 is communicated with the interior of the discharge manifold 42 by means of a horizontally spaced series of vertically serpentined flow transfer tubes 44 each connected at its opposite ends to the manifolds 40, 42 and having a considerably smaller diameter than the primary tubes 34.

Three horizontally spaced apart main gas burners 46 are operatively mounted within a lower portion of the chamber 30 and are supplied with gaseous fuel (such as natural gas), through supply piping 48 (FIG. 5), by a gas valve 50. It will be appreciated that a greater or lesser number of primary tubes 34, and associated burners 46 could be utilized, depending on the desired heating output of the furnace.

Figure 5:
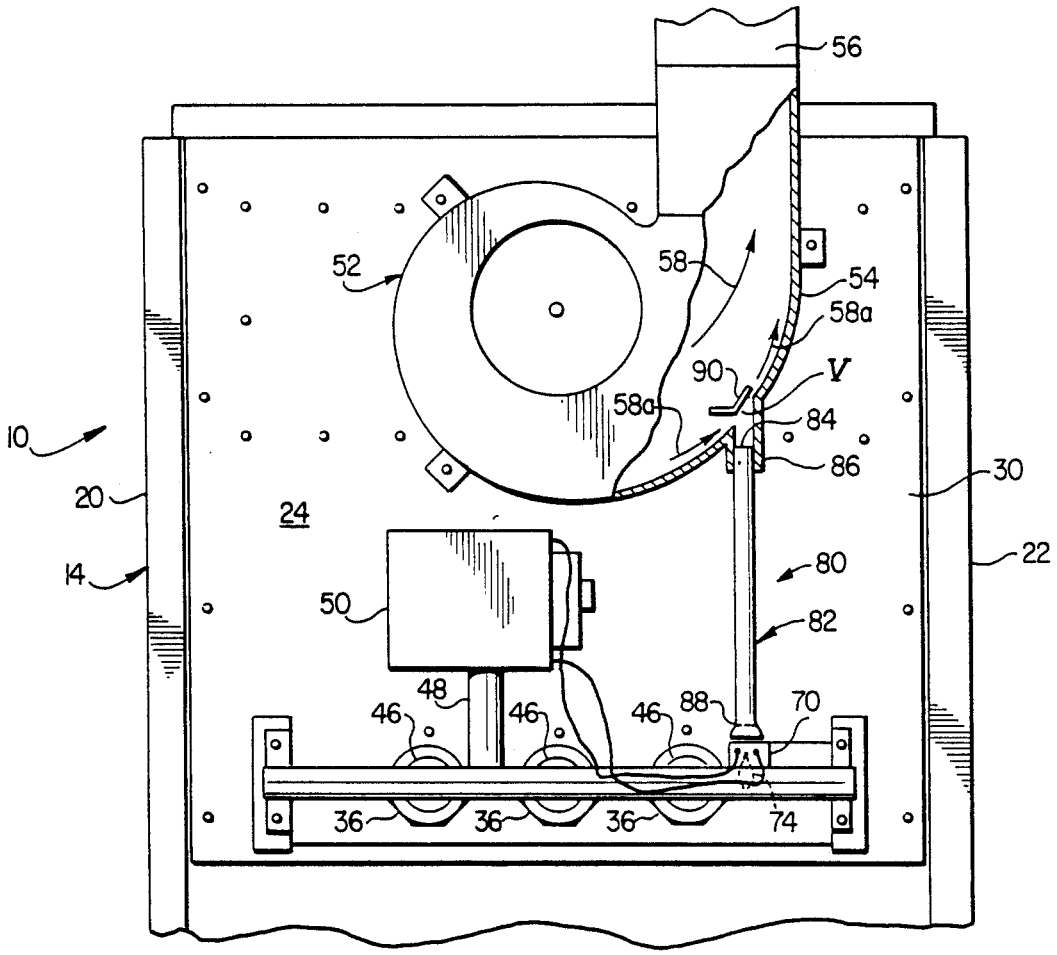
FIG. 5 is an enlarged scale, partially sectioned interior elevational view of the furnace, taken along line 5—5 of FIG. 1, and illustrates a pilot gas bypass system used in conjunction with the heat exchanger.

A draft inducer fan 52 positioned within the chamber 30 is mounted on an upper portion of the interior wall 24, above the burners 46, and has an inlet communicating with the interior of the discharge manifold 42, and an outlet section 54 coupled to an external exhaust flue 56 (FIG. 5).

Upon a demand for heat from the furnace 10, by a thermostat (not illustrated) located in the space to be heated, the burners 46 and the draft inducer fan 52 are energized. Flames and products of combustion 58 from the burners 46 are directed into the open inlet ends 36 of the primary heat exchanger tubes 34, and the combustion products 58 are drawn through the heat exchanger 12 by operation of the draft inducer fan 52. Specifically, the burner combustion products 58 are drawn by the draft inducer fan, as indicated in FIG. 2, sequentially through the primary tubes 34, into the inlet manifold 40, through the flow transfer tubes 44 into the discharge manifold 42, from the manifold 42 into the inlet of the draft inducer fan 52, and through the fan outlet section 54 into the exhaust flue 56.

At the same time return air 60 (FIG. 1) from the heated space is drawn upwardly into the inlet plenum 32 and flowed into the inlet 62 of a supply air blower 64 disposed therein. Return air 60 entering the blower inlet 62 is forced upwardly into the supply air plenum 28 through an opening 66 in the interior housing wall 26. The return air 60 is then forced upwardly and externally across the heat exchanger 12 to convert the return air 60 into heated supply air **60*a* which is upwardly discharged from the furnace through a top end outlet opening 68 to which a suitable supply ductwork system (not illustrated) is connected to flow the supply air 60*a*** into the space to be heated.

Referring now to FIGS. 1 and 5, a conventional pilot assembly 70 is suitably mounted within the furnace chamber 30 immediately to the right of the rightmost burner 46 adjacent its discharge end. The pilot assembly 70 is supplied with gaseous fuel through a small supply conduit 72 (FIG. 6), and is operative to continuously maintain within the chamber 30 a standing pilot flame 74 which functions to ignite gaseous fuel discharged from the burners 46 when the gas valve 50 is opened in response to a thermostat demand for heat from the furnace 10. The pilot flame 74 is maintained during both operative periods of the furnace (during which the burners 46 and the draft inducer fan 52 are energized) and idle periods of the furnace (during which the burners 46 and the draft inducer fan 52 are de-energized).

The uniquely configured heat exchanger 12 provides a variety of advantages over conventional clamshell type heat exchangers typically utilized in residential furnaces such as the illustrated furnace 10. For example, the heat exchanger 12 is very compactly configured, particularly in its vertical direction, which permits the furnace 10 to be significantly shorter than conventional gas-fired furnaces of similar heat capacities and, due to the significantly decreased weight of the heat exchanger 12 compared to conventional clamshell type heat exchangers, considerably lighter. In turn, this advantageously reduces the shipping costs for the furnace 10 since more furnaces can be stacked on a given shipping truck.

Compared to conventional clamshell type heat exchangers, the compact heat exchanger 12 has a greatly reduced metal mass. This advantageously reduces the cold start-up "dwell period" of the heat exchanger 12, thereby inhibiting internal corrosion, since the heat exchanger 12 heats up considerably faster when the burners 46 are energized and an initial flow of burner combustion products through the heat exchanger is initiated.

The small diameter, vertically serpentined flow transfer tubes 44 of the heat exchanger provide it with a relatively high internal pressure drop, and imparts a desirable turbulence to the burner combustion product flow through the heat exchanger, which correspondingly increases the efficiency of the heat exchanger during burner operation. This relatively high internal flow resistance of the heat exchanger 12 also inhibits rapid escape flow therethrough of hot combustion products after burner shutoff (with the blower 64 still running), thereby efficiently capturing heat which would otherwise escape into the exhaust flue.

Moreover, and quite importantly, the unique configuration of the compact heat exchanger 12 substantially reduces outward heat losses through the vertically extending housing side walls to thereby increase the overall efficiency rating of the furnace 10. As can best be seen in FIGS. 3 and 4 the heat exchanger 12 occupies a total volume $L \times W \times H$ within the supply plenum 28 of housing 14, this volume being considerably smaller than that occupied by a conventional clamshell type heat exchanger of equivalent heating capacity. Around the external periphery of this compact volume, the total vertically facing surface area of the heat exchanger 12 (i.e., the peripheral surface area facing parallel to air flow through plenum 28 across the heat exchanger) is considerably greater than the total peripheral surface area facing the vertical side walls 16, 18, 20 and 22 of the housing 14 (i.e., the surface area disposed transversely to the air flow through the plenum 28).

The vertically facing peripheral surface area of the heat exchanger 12 outwardly facing the vertical housing side walls includes the upper and lower side surfaces of the manifolds 40 and 42, the upper side surfaces of all of the flow transfer tubes 44, and the lower side surfaces of the three primary tubes 34. The considerably smaller horizontally facing peripheral surface area of the heat exchanger 12 directly facing the furnace side walls includes only the end surfaces of the manifold 40 and 42, the outer side surface of the manifold 40, the outer side surfaces of two of the tubes 34, and the outer side surfaces of two of the tubes 44.

Accordingly, the horizontally directed radiant heat $R_1$ (FIG. 3) emanating from the periphery of the heat exchanger 12 during a given heating cycle is considerably less than the radiant heat $R_2$ (FIG. 4) directed parallel to the forced air flow within the chamber 28—exactly opposite from the radiant heat flow distribution proportion present in conventional clamshell type heat exchangers.

Thus, the total radiant heat emanating from the periphery of the heat exchanger 12 within the housing 14 is far more efficiency apportioned between the air flow within the plenum 28 and the vertically extending housing side walls. Because a significant lesser percentage of total heat exchanger radiant heat is directed from the heat exchanger periphery toward such housing side walls, more of such radiant heat is transferred to the supply air, and outwardly directed housing heat loss is reduced, thereby increasing the overall heat efficiency rating of the furnace under the new rating formula. Despite these various advantages, however, the heat exchanger 12 is simple and relatively inexpensive to fabricate from uncomplicated and easily manufactured components.

The standing pilot flame system incorporated in the furnace 10 is typically used in conjunction with low pressure drop heat exchangers, such as conventional clamshell heat exchangers, and is quite desirably due to its simplicity, low cost and reliability. However, as is well known in the furnace art, standing pilot flame ignition systems have heretofore been considered not to be particularly well suited for use with furnace heat exchangers having relatively high internal pressure drops.

This is due to the fact that the pilot flame combustion products 76 (FIG. 6) continuously generated within the furnace housing during idle periods of the furnace tend to migrate into the exhaust flue through the unfired heat exchanger. When a relatively high pressure drop heat exchanger is utilized, these hot pilot flame combustion products are retained for considerably longer periods within the much cooler heat exchanger interior, thereby undesirably accelerating internal heat exchanger corrosion as the hot combustion products from the standing pilot flame condense on the considerably cooler interior surface of the unfired heat exchanger during idle furnace periods. This well known incompatibility between a standing pilot flame ignition system and furnace heat exchangers having relatively high pressure drops has heretofore resulted in the necessity of replacing the standing pilot flame ignition system with a costlier and more complex electric ignition system to prolong the useful life of the heat exchanger.

Figure 6:
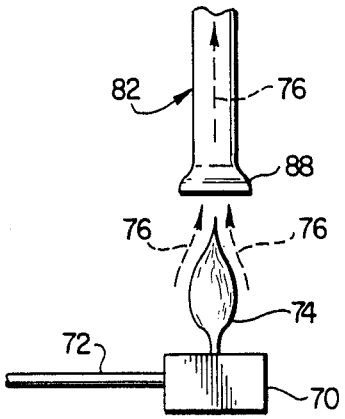
FIG. 6 is a simplified schematic diagram illustrating the operation of a vent tube portion of the pilot gas bypass system.

In the present invention, however, this incompatibility is essentially eliminated, thereby permitting the use of the standing pilot flame ignition system with the high pressure drop heat exchanger 12, by the provision of a novel pilot bypass system 80 which will now be described with reference to FIGS. 5 and 6. The pilot bypass system 80 includes a small diameter, vertically oriented pilot flame vent tube 82 disposed within the furnace chamber 30. As best illustrated in FIG. 5, the open upper end 84 of the vent tube 82 is received within downwardly projecting collar fitting 86 secured to a bottom side of the draft inducer fan outlet section 54. The open lower end 88 of the vent tube 82 is positioned immediately above the standing pilot flame 74.

During idle periods of the furnace 10, the combustion products 76 generated by the standing pilot flame 74 do not deleteriously migrate through the interior of the heat exchanger 12. Instead, such combustion products 74, by natural draft effect, flow upwardly through the vent tube 82 into the interior of the draft inducer fan outlet section 54 and pass upwardly therefrom into the exhaust flue 56. This is due to the fact that the vent flow passage within the tube 82 has, with respect to the pilot flame combustion products, and effective internal flow resistance less than that of the heat exchanger 12, and the pilot flame combustion products 76 take this path of least resistance during idle periods of the furnace—i.e., when neither the burners 46 nor the draft inducer fan 52 are energized.

Accordingly, even though a relatively high pressure drop heat exchanger is utilized in the furnace 10, it is not necessary to use an electric ignition device (with its attendant complexity and expense), which must be operated each time the gas valve 50 is opened, to prevent internal corrosion of the heat exchanger by pilot flame combustion products. Instead, due to the use of the vent tube 82, the much simpler and less expensive pilot assembly 70 may be utilized since the combustion products from its standing pilot flame completely bypass the heat exchanger and are essentially prevented from corrosively attacking the interior of the heat exchanger during idle periods of the furnace.

It can be seen that the vent tube 82 is connected to a section of the draft inducer fan 52 (i.e., it outlet section 46) which, during operation of the fan 52, is under a positive pressure. To prevent this positive pressure from creating a downflow of burner combustion products 58 through the vent tube 82 (which would tend to snuff out the standing pilot flame 74) a small metal scoop vane 90 is suitably secured within the draft inducer fan outlet section 54, near its juncture with the collar fitting 86, as best illustrated in FIG. 5.

During operation of the fan 52, a major portion of the burner combustion products 58 is forced upwardly through the outlet section 54 into the exhaust flue 56. However the vane 90 functions to intercept a small portion **58*a* of the combustion product flow 58 and direct it past the inner end of the collar fitting 86 with increased velocity. The increased velocity of the combustion product flow stream 58*a* creates in this area a venturi area V. This venturi, in turn, creates a negative pressure adjacent the upper end of the collar fitting 86, thereby maintaining a negative pressure within the interior of the vent tube 82 and accordingly preventing an undesirable downflow therethrough of burner combustion products 58 during operation of the draft inducer fan 52**.

The installation of the vent tube 82 and the venturi vane 90 may be very easily and inexpensively carried out, and does not significantly increase the overall manufacturing cost of the high efficiency furnace 10. Additionally, the vent tube 82 and the venturi vane 90 are essentially maintanence free additions to such furnace.

Although the pilot bypass system 80 just described permits a standing pilot flame ignition system to be utilized in conjunction with the high pressure drop heat exchanger 12, it will be appreciated that, if desired, an electric ignition system could be used instead to even further increase the heat efficiency rating of the furnace.

While the compact, high efficiency heat exchanger 12 has been representatively illustrated in an upflow furnace, it will be readily appreciated that it could also be utilized in downflow or horizontal flow furnaces. In such furnaces of different flow orientations, the heat exchanger would be oriented in the supply air plenum in a manner such that the major side surface area of the heat exchanger would face in a direction parallel to the air flow through the supply air plenum, so that the rated heat efficiency improvements described in conjunction with the upflow furnace 10 could be achieved.

The foregoing detailed description is to be clearly understood as being given by way of illustration and example only, the spirit and scope of the present invention being limited solely by the appended claims.

What is claimed is:

1. A single heat exchanger for providing essentially the entire combustion products-to-supply air heat exchanger in a fuel-fired, forced air furnace having a housing portion through which supply air is forced generally parallel to a side wall section of the housing portion, said heat exchanger comprising:

an inlet manifold;

an outlet manifold spaced apart in a first direction from said inlet manifold and being connectable to the inlet of a draft inducer fan operative to draw hot combustion products through said heat exchanger;

at least one relatively large diameter primary inlet tube adapted to receive hot combustion products from a source thereof and flow the received combustion products into said inlet manifold, each of said at least one primary inlet tube having a discharge portion connected to said inlet manifold and projecting outwardly therefrom in a second direction transverse to said first direction, and an inlet portion extending from an outer end portion of the discharge portion, in said first direction, toward said inlet manifold; and a series of relatively small diameter flow transfer tubes each connected at its opposite ends to said inlet manifold and said outlet manifold, said flow transfer tubes being operative to flow hot combustion products from said inlet manifold to said outlet manifold and configured to create a substantial internal flow resistance in said heat exchanger, said heat exchanger being operatively positionable within said housing portion in a manner such that said first direction of said heat exchanger extends generally transversely to said side wall section, said heat exchanger having a first total peripheral surface area facing in said second direction, and a second total peripheral surface area facing generally perpendicularly to said second direction, said first total peripheral surface area being substantially greater than said second total peripheral surface area, whereby, when said single heat exchanger is operatively installed within said housing portion, the radiant heat transferred from said single heat exchanger to supply air flowing through said housing portion is substantially greater than the radiant heat transferred from said single heat exchanger to said side wall section of the furnace, thereby materially increasing the heating efficiency rating of the furnace.

2. The heat exchanger of claim 1 wherein:

said flow transfer tubes are serpentined in said second direction.

3. Induced draft, fuel fired furnace apparatus comprising:

a housing having an external side wall section extending in a first direction;

burner means selectively operable to receive fuel from a source thereof and discharge the received fuel;

pilot means for creating and continuously maintaining a standing pilot flame which generates hot combustion products within said housing;

heat exchanger means disposed within said housing for receiving an internal throughflow of hot burner means combustion products and transferring heat therefrom to air flowed externally across said heat exchanger means in said first direction, said heat exchanger means having a relatively high resistance to combustion product flow therethrough, a first total peripheral surface area facing in said first direction, and a second total peripheral surface area facing said housing side wall section, said first total peripheral surface area being substantially greater than said second total peripheral surface area so that the amount of radiant heat generated by said heat exchanger means in said first direction is substantially greater than the amount of radiant heat generated by said heat exchanger means toward said housing side wall section to thereby increase the heating efficiency rating of said furnace apparatus;

supply air blower means for flowing air externally across said heat exchanger means in said first direction;

draft inducing fan means connected to said heat exchanger means and connectable to an external exhaust flue, said draft inducing fan means being selectively operable to sequentially draw hot combustion products discharged from said burner means through said heat exchanger means and discharge combustion products exiting said heat exchanger means into and through the exhaust flue; and vent means for venting hot combustion products from said standing pilot flame into the exhaust flue through said draft inducing fan means, during idle periods thereof, in a manner precluding an appreciable amount of pilot flame combustion products from interiorly traversing said heat exchanger means.

4. The furnace apparatus of claim 3 wherein:

said draft inducing fan means have an outlet section, said vent means includes means for defining a vent inlet flow passage extending from adjacent said standing pilot flame into the interior of said outlet section of said draft inducing fan means and bypassing the interior of said heat exchanger means, and said furnace apparatus further comprises means for preventing fluid flow through said vent inlet flow passage, from said outlet section of said draft inducing fan means toward said standing pilot flame, during operation of said draft inducing fan means.

5. The furnace apparatus of claim 4 wherein:

said means for preventing fluid flow include means, responsive to operation of said draft inducing fan means, for creating a negative pressure within said vent inlet flow passage.

6. The furnace apparatus of claim 5 wherein:

said means for preventing fluid flow include means, responsive to operation of said draft inducing fan means, for creating a venturi flow area positioned within said outlet section adjacent its juncture with said vent inlet flow passage.

7. The furnace apparatus of claim 6 wherein:

said means for defining a vent inlet flow passage include a vent tube extending from said outlet section to adjacent said standing pilot flame.

8. The furnace apparatus of claim 3 wherein said heat exchanger means include:

an inlet manifold, an outlet manifold spaced apart from said inlet manifold in a second direction transverse to said first direction, said draft inducer fan means having an inlet connected to said outlet manifold, at least one relatively large diameter primary inlet tube adapted to receive hot burner means combustion products and flow the received combustion products into said inlet manifold, each of said at least one primary inlet tube having a discharge portion connected to said inlet manifold and projecting outwardly therefrom in said first direction, each of said at least one primary tube being positioned upstream of said inlet and outlet manifolds with respect to external air flow across said heat exchanger means, and an inlet portion extending in said second direction, generally toward said inlet manifold, from an outer end portion of the discharge portion, and a series of relatively small diameter flow transfer tubes each connected at its opposite ends to said inlet manifold and said outlet manifold, said flow transfer tubes being operative to flow hot combustion products from said inlet manifold to said outlet manifold and configured to create a substantial internal flow resistance in said heat exchanger means.

9. The furnace apparatus of claim 8 wherein:

said flow transfer tubes are serpentined in said first direction.

* * * * *

UNITED STATES PATENT AND TRADEMARK OFFICE

CERTIFICATE OF CORRECTION

PATENT NO. : 4,974,579

DATED : December 4, 1990

INVENTOR(S) : Timothy J. Shellenberger and William T. Harrigill

It is certified that error appears in the above-identified patent and that said Letters Patent is hereby corrected as shown below:

Column 8, line 52, "changer" should be --change--.
Column 9, line 4, "inlet" should be --outlet--.

Signed and Sealed this

Twenty-third Day of June, 1992

*Attest:*

DOUGLAS B. COMER

*Attesting Officer*

*Acting Commissioner of Patents and Trademarks*